US005863213A

United States Patent [19]

Enomoto et al.

[11] Patent Number: 5,863,213

[45] Date of Patent: Jan. 26, 1999

[54] MEMORY CARD CONNECTOR AND ADAPTER THEREFOR

[75] Inventors: Ikuo Enomoto, Tokyo; Katsuhiko Kobayashi, Yamanashi, both of Japan

[73] Assignee: The Whitaker Corporation, Wilmington, Del.

[21] Appl. No.: 959,868

[22] Filed: Oct. 29, 1997

[30] Foreign Application Priority Data

Oct. 30, 1996 [JP] Japan ..... 8-303928

[51] Int. Cl.[6] ..... H01R 13/62

[52] U.S. Cl. ..... 439/326; 439/327

[58] Field of Search ..... 439/325, 326, 439/327, 328, 629, 630–636

[56] References Cited

U.S. PATENT DOCUMENTS 4,737,120 4/1988 Grabbe et al. ..... 439/326
4,850,892 7/1989 Clayton et al. ..... 439/326
5,263,870 11/1993 Billman et al. ..... 439/108
5,383,792 1/1995 Korsunsky et al. ..... 439/326
5,484,302 1/1996 Yamada et al. ..... 439/326

*Primary Examiner*—Khiem Nguyen
*Attorney, Agent, or Firm*—Robert Kapalka

[57] ABSTRACT

An adapter is removably mountable on one end of a memory card of predetermined length. The adapter has a protrusion which registers with a notch in the end of the memory card, and the adapter has a substitute notch which provides the memory card with an effective length that is equal to a specified longer length than the predetermined length. The adapter permits the memory card of predetermined length to be reliably mated with an electrical connector that is dimensioned to receive a memory card of the specified longer length.

4 Claims, 3 Drawing Sheets

MEMORY CARD CONNECTOR AND ADAPTER THEREFOR

FIELD OF THE INVENTION

The invention relates to a memory card electrical connector, and in particular, to an adapter for use with a memory card in an electrical connector.

BACKGROUND OF THE INVENTION

With the spread of personal computers (PC's), their performance is advancing at a great rate. As integrated circuit (IC) technologies advance, the volume of memory elements is constantly increasing along with performance characteristics of personal computers.

Computer users tend to purchase a computer at a price they can afford with a lowest acceptable memory mounted on the mother board which is expanded later as needs may be by plugging single in-line memory modules (SIMM's), dual in-line memory modules (DIMM's) or other memory elements into sockets provided for that purpose on the mother board. This arrangement makes it possible to buy a PC at a minimum investment and upgrade it later using up-to-date memory cards, thus providing an effective solution for both makers and users of personal computers.

Among connectors (or sockets) for such memory cards, SIMM sockets (e.g., U.S. Pat. Nos. 4,737,120; 4,850,892), DIMM sockets (e.g., U.S. Pat. No. 5,263,870), Small Outline DIMM sockets (e.g., U.S. Pat. No. 5,484,302), etc., are known in the art.

These sockets for memory cards comprise an insulative housing having an elongated slot with one or two rows of contacts arranged at a predetermined pitch along the slot. An edge of a memory card is inserted between the contact rows at one angle using low insertion force, after which it is rotated to a second angle resulting in the formation of spring loaded connections between contact pads formed along the edge of the memory card on one side (SIMM), or two sides (DIMM), and contacts of the socket. During rotation of the memory card to the second angle, the card is latched in the insulating housing of the socket by means of a latching device. When it is necessary, the latching devices can be released, the memory card can be rotated to the first angle and easily removed from the socket.

These memory cards may have either 150 contact pads (150P-type memory cards) or 144 contact pads (144P-type memory cards) arranged at a pitch of, for example, 0.8 mm on one or both sides of the card edge. These two types of memory cards are usually of the same thickness and the same height, but the length is either 70 mm or 67.6 mm. Because of the difference in length, memory cards of the 150P and 144P types can be used only in connectors designed specifically for that type of memory card. In other words, memory cards of the 150P type cannot be inserted in connectors for memory cards of the 144P type. Memory cards of the 144P type can be inserted in connectors for memory cards of the 150P type, but they cannot be retained in the connector housing by the latching device, resulting in unreliable electrical connections between the contact pads of the memory card and the contacts of the connector. Situations when it is impossible to use memory cards of the 144P type in connectors intended for memory cards of the 150P type, such as when the 144P card was purchased by mistake or was otherwise available, result in inconvenience for the user and additional expense.

SUMMARY OF THE INVENTION

Thus, it is an object of the invention to offer a memory card connector system which makes it possible to interchange memory cards of the 150P and 144P types by reliably latching them in a single connector without wasting available memory cards.

A connector system according to the invention makes it possible to reliably insert a short memory card into a connector designed for a long memory card by attaching an adapter to the short memory card, thus giving the short memory card an effective length which is the same as the length of the long memory card. The outside configuration of the adapter is the same as the configuration of the latchable portion of the long memory card. Therefore, the latching mechanism of the connector for long memory cards can operate in a normal manner. In addition, the short memory card can still be installed in a connector designed for short memory cards by simply removing the adapter from the short memory card.

In a preferred embodiment the adapter for a memory card has on its inner side (the side facing the memory card) a channel or groove of the same width as the thickness of the memory card, a protrusion inside the channel which corresponds in shape to the latching notch of the memory card, and a latch pin receiving notch on its outer side into which the latching arm of the connector fits. Therefore, the adapter can be easily fitted on the memory card by registering the protrusion of the adapter with the latching pin receiving notch of the card.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
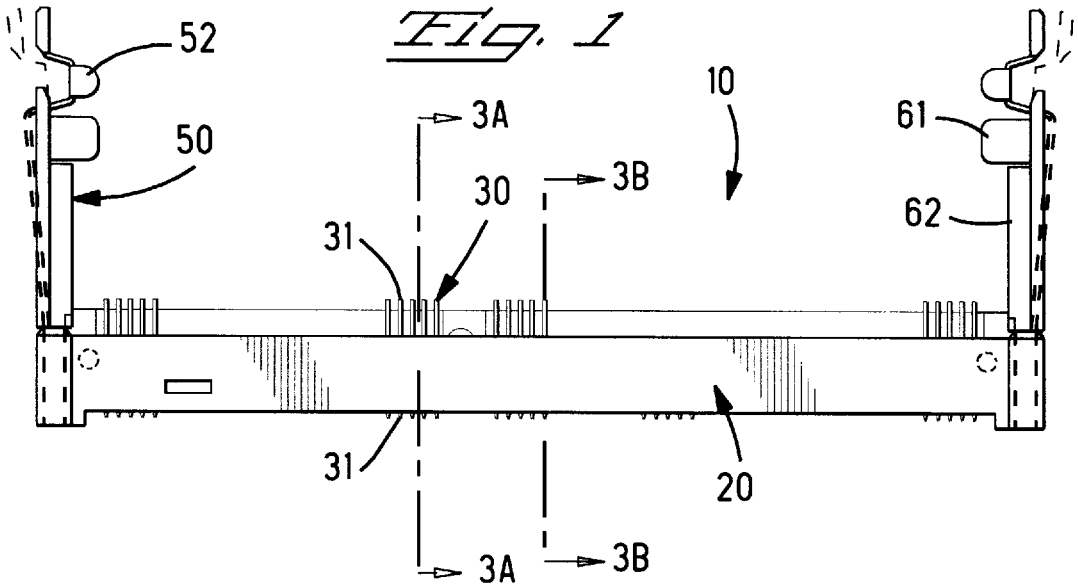
FIG. 1 is a top plan view of an electrical connector for memory cards according to the invention.

An electrical connector main body 10 comprises an elongated housing 20 having two rows (upper and lower) of contacts 30 arranged within the housing and a pair of spring-loaded latching arms 50, which may be made of metal, secured at opposite ends of the housing 20. The latching arms 50 have guide plates 62 for guiding the memory card 100 into the housing, lugs 61 which are securable to a printed circuit motherboard, and latch pins 52 which retain a memory card in the housing. The latching arms 50 are each made in the form of a single-supported cantilever having a free end which can be pushed outwardly by a finger to the position shown by the broken lines in FIG. 1, thus releasing the latched memory card 100.

Figure 2:
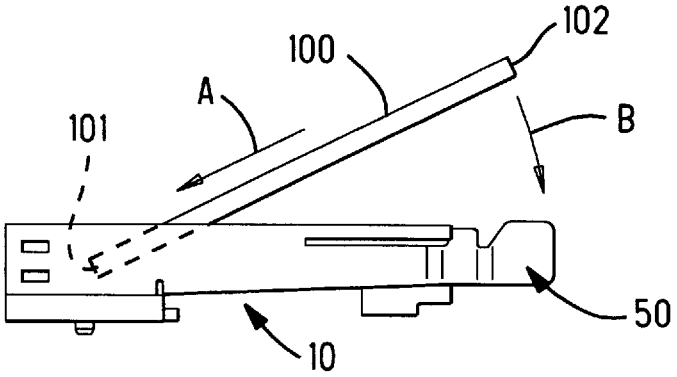
FIG. 2 is a side view of the connector showing a memory card being inserted therein.

In order to insert the memory card 100 into the main body 10, a leading edge 101 of the memory card is inserted along the guide plates 62, as shown in FIG. 2, in the direction of arrow A (at a first angle) into an elongated slot (not shown in FIG. 2) formed in the housing 20 between the rows of contacts 30. After the memory card is sufficiently inserted, trailing edge 102 of the memory card 100 is pivoted in the direction of arrow B (to a second angle). As a result, edges of the board in the area of latch pin receiving notches 106 located at both ends of the memory card 100 come in contact with the latch pins 52, thus spreading the latching arms 50 outwardly. Further pivoting of the memory card 100 in the direction of arrow B brings the card to a position below the latch pins 52 and permits the latching arms 50 to return to their original position by the action of the spring-loaded mechanism. The latch pins 52 retain the memory card at the second angle which is parallel to the mother board (not shown in the drawing).

In this position, a rotating moment is applied to the memory card 100 which works to lift the trailing end 102 upward (to the position shown in FIG. 2). Therefore, as soon as the latching arms are spread outward, the memory card 100 is released, and it is returned to the first angle by spring-loaded action of the contacts 30. In this position, the memory card 100 can be easily pulled out from the connector main body 10 in a direction opposite to the direction of arrow A.

Figure 3A:
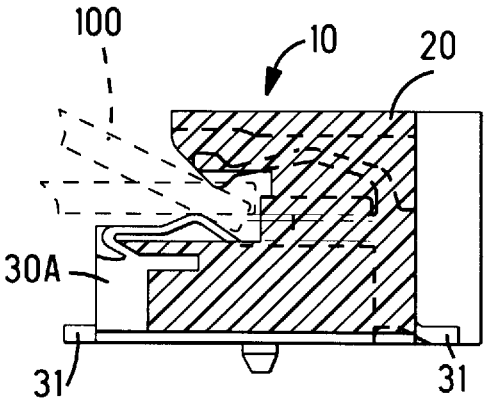
FIG. 3A is a cross-sectional view taken along line 3A—3A in FIG. 1.
Figure 3B:
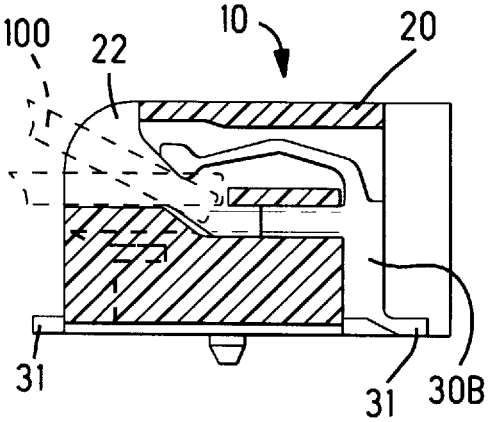
FIG. 3B is a cross-sectional view taken along line 3B—3B in FIG. 1.

FIGS. 3A and 3B show cross-sections through the connector main body along lines 3A—3A and 3B—3B in FIG. 1. As shown in these drawings, two types of contacts 30A and 30B are alternately arranged along both sides of the housing 20, and surface mount tails 31 of both types of contacts are soldered to contact pads arrayed on the surface of the mother board. The housing 20 has an elongated slot 22 formed between the rows of contacts 30A and 30B and into which the memory card 100 is inserted.

Figure 4:
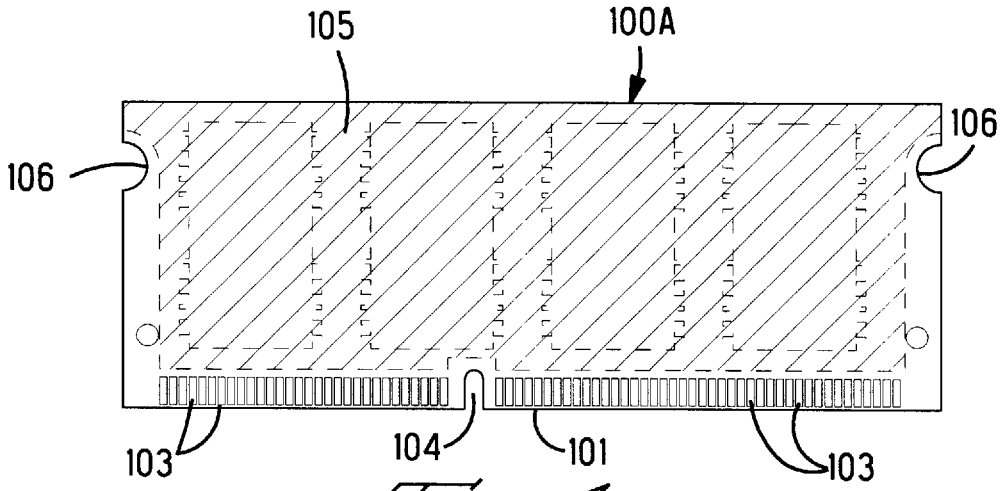
FIG. 4 is a plan view of a memory card of standard length which can be used in the connector according to the invention.
Figure 5:
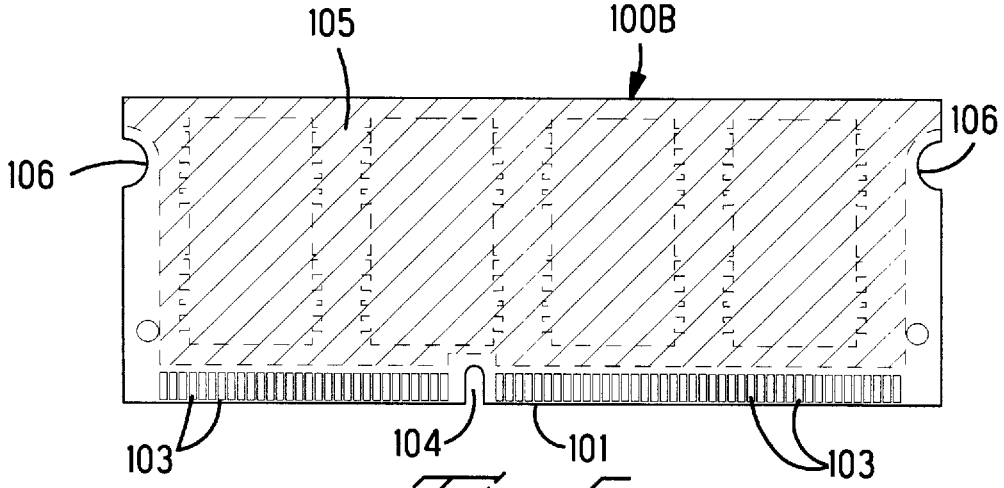
FIG. 5 is a plan view of a relatively shorter memory card.
Figure 6:
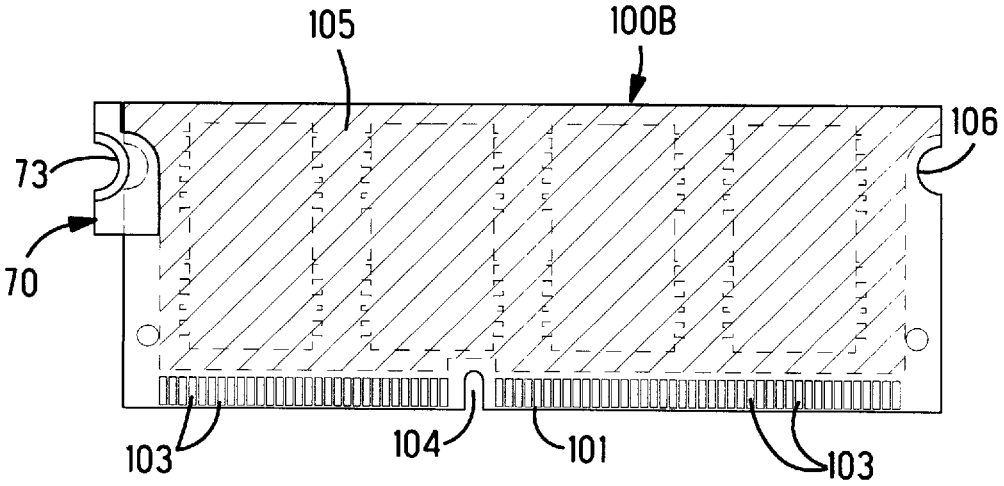
FIG. 6 is a plan view of the memory card of FIG. 5 along with an adapter according to the invention.

FIGS. 4–6 show memory cards which can be used in conjunction with the memory card connector according to this invention. FIG. 4 depicts a relatively long memory card 100A of the 150P type. This card has a length of 70 mm. In the drawing, hatched section 105 represents an area where memory devices are located. At leading edge 101 of the memory card 10A, a total of 150 contact pads 103 are arranged on both sides of the card at a pitch of 0.8 mm. A notch 104 is formed at an intermediate location along the edge 101. In addition, semicircular notches 106 are provided at both ends of the card for the purpose of receiving the latch pins of the connector latching arms.

FIG. 5 depicts a relatively short memory card 100B of the 144P type. This card has a predetermined length of 67.6 mm. At leading edge 101 of the memory card 100B, a total of 144 contact pads 103 are arranged on both sides of the card at a pitch of 0.8 mm. This card has the same notch 104 and the notches 106 as the memory card 100A shown in FIG. 4.

And finally, FIG. 6 depicts the memory card 100B of FIG. 5 along with an adapter 70 which is attached to one of the notches 106 of the memory card. The adapter 70 has a substitute notch 73. A comparison of FIGS. 4 and 6 shows that the effective length of the memory card 100B between the notches 73 and 106 is equal to the specified length of the memory card 100A between both notches 106, that is 70 mm. Also, the pitch of the contact pads 30 is the same. The only difference between the cards is in the number of contacts pads 30, the memory card 100A having 6 more contacts than the memory card 100B.

Figure 7:
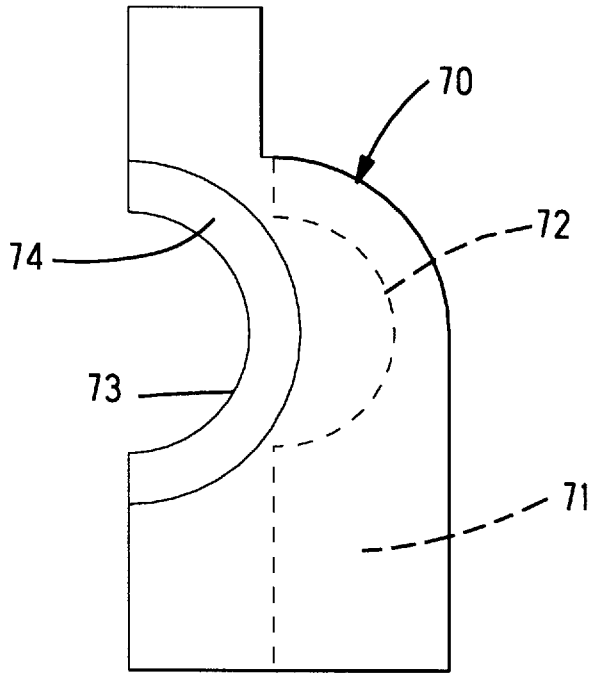
FIG. 7 is an enlarged plan view of the adapter.

FIG. 7 is an enlarged view of the adapter 70 according to this invention. As an example, the adapter can be 11 mm long, 3.2 mm thick and 5.3 mm wide. It is preferably made of a plastic material by molding.

Figure 8:
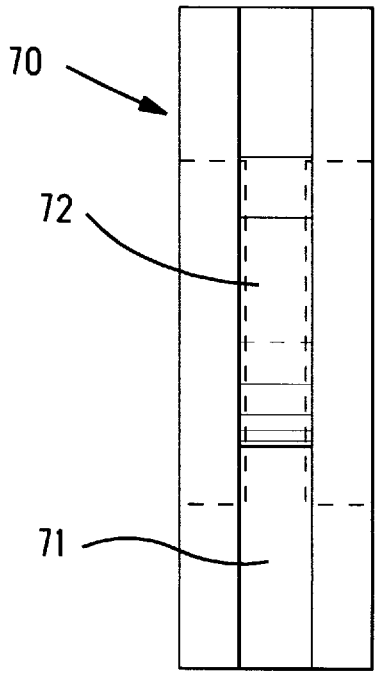
FIG. 8 is an enlarged side view of the adapter.

As shown in FIG. 8, the adapter 70 has a channel or groove 71 with a width that is substantially equal to the thickness of the memory card 100B so that the end of the memory card can be closely held in the channel. Inside the channel 71, a semicircular protrusion 72 is formed with a configuration that corresponds to the shape of the notch 106 that is shown on the left-hand side of the memory card 100B in FIG. 5. Therefore, when the end of the memory card 100B is inserted in the channel 71 of the adapter 70, the adapter will be located along the end by registration of the protrusion 72 in the notch 106. The channel 71 has a depth which is selected such that the effective length of the memory card 100B having the adapter 70 thereon is increased by the difference in length of the memory cards 100A and 100B, that is by 70 mm–67.6 mm=2.4 mm.

In addition, as can be seen in FIG. 7, the adapter 70 has a semicircular substitute notch 73 which is adapted to receive the latch pin 52 in the same manner as the notch 106 of the memory card 100B. A wall 74 of the adapter which is adjacent to the notch 73 is made very thin so that it is substantially even with the surface of the memory card 100B when the adapter is affixed to the memory card.

When the adapter 70 is affixed to the memory card 100B and the protrusion 72 is in registration with the latch pin receiving notch 106, we obtain a configuration shown in FIG. 6. When the memory card 100B with the adapter 70 affixed thereto is inserted in the connector main body 10 shown in FIGS. 1 and 2, a memory card connector system according to this invention is implemented.

Above, we gave detailed explanations concerning a preferred embodiment of the memory card connector and adapter according to this invention. However, this invention is not limited to the embodiment described above, but it also covers various modifications which can be made as needed.

In this manner, the memory card connector according to this invention makes it possible to use, along with standard memory cards, memory cards that are shorter than the standard length simply by attaching the adapter. This feature makes the memory card connector universal and flexible in use and provides for an efficient use of memory cards.

In addition, the adapter according to this invention is very simple in design and it can be fabricated from a suitable plastic material by molding at a low cost. Since the adapter is attached using the latch pin receiving notch of the memory card for reference, the process is fast and easy. Since the latching arms of the connector do not need any adjustment, the connector can be used as is.

Therefore, if a user intermittently uses memory cards of the 150P and 144P types, the user only needs a connector for 150P type memory cards, and when it is desirable to switch to a 144P type memory card, the 144P type memory card can be used with the adapter according to the invention, thus making the 150P and 144P type cards interchangeable.

We claim:

1. An adapter for use with a memory card of a type which has a length extending between opposite ends and a notch in each of the ends, the adapter comprising:

an adapter body which is removably mountable on a memory card of predetermined length, the adapter body having a protrusion which registers with the notch in one of the ends to align the adapter body on the memory card, and the adapter body having a substitute notch which is arranged to provide the memory card with an effective length which is a specified longer length than the predetermined length, wherein the memory card can be reliably mated with an electrical connector that is dimensioned to receive a memory card having the specified longer length.

2. The adapter according to claim 1 wherein the adapter body has a channel with a width that is substantially equal to a thickness of the memory card so that the one end of the memory card can be closely received in the channel.

3. A memory card connector system comprising:

a memory card having a predetermined length extending between opposite ends and a notch in each of the ends;

an electrical connector including a housing having an elongated slot and an array of contacts arranged along the slot for engaging contact pads on a memory card which is inserted into the slot, the housing having opposite ends with a resilient latch arm at each of the ends for securing in the slot a memory card of specified longer length than the predetermined length; and an adapter which is removably mountable on one of the ends of the memory card of predetermined length, the adapter having a protrusion which registers with the notch in the one end to align the adapter on the memory card, and the adapter having a substitute notch which is arranged to provide the memory card with an effective length that is equal to the specified longer length, wherein the memory card of predetermined length can be reliably mated in the electrical connector.

4. The memory card connector system according to claim 3 wherein the adapter has a channel with a width that is substantially equal to a thickness of the memory card so that the one end of the memory card can be closely received in the channel.

* * * * *